US006110551A

United States Patent [19]

Exline et al.

[11] Patent Number: 6,110,551

[45] Date of Patent: Aug. 29, 2000

[54] ADHESIVE STRIP FOR USE IN A WALLET SIZE CARD BOOK

[75] Inventors: William B. Exline, Chagrin Falls; Michael P. Exline, Novelty, both of Ohio

[73] Assignee: William Exline, Inc., Cleveland, Ohio

[21] Appl. No.: 08/783,813

[22] Filed: Jan. 16, 1997

Related U.S. Application Data

[63] Continuation-in-part of application No. 08/418,567, Apr. 7, 1995, Pat. No. 5,595,401.

[51] Int. Cl.[7] ..... B42D 1/00

[52] U.S. Cl. ..... 428/40.1; 281/2; 281/3.1; 281/5; 283/34; 283/36; 283/56; 283/904; 428/41.3; 428/194

[58] Field of Search ..... 428/40.1, 41.3, 428/194; 283/904, 34, 36, 56; 281/2, 3.1, 5

[56] References Cited

U.S. PATENT DOCUMENTS

| | | | |
|---|---|---|---|
| 286,650 | 10/1883 | Talcott . | |
| 807,648 | 12/1905 | Wiggins . | |
| 1,912,710 | 6/1933 | Kennedy . | |
| 2,634,777 | 4/1953 | Berger | 150/59 |
| 2,718,911 | 9/1955 | Solomon | 150/39 |
| 2,767,756 | 10/1956 | Niles | 150/39 |
| 3,201,146 | 8/1965 | Tilton, Jr. | 281/31 |
| 3,310,321 | 3/1967 | Freund | 281/31 |
| 3,360,027 | 12/1967 | Price | 150/39 |
| 3,433,279 | 3/1969 | Seamon | 150/39 |
| 3,526,567 | 9/1970 | Macone | 428/194 |
| 3,537,728 | 11/1970 | Reese | 281/31 |
| 4,216,979 | 8/1980 | Janik | 283/58 |
| 4,320,868 | 3/1982 | Petersson | 428/194 |
| 4,492,390 | 1/1985 | Jacobs et al. | 281/31 |
| 4,586,729 | 5/1986 | Beylerian | 281/5 |
| 4,620,725 | 11/1986 | Maehashi | 281/45 |
| 4,621,729 | 11/1986 | Jackson | 206/37 |
| 4,896,027 | 1/1990 | Drexler | 235/488 |
| 5,143,405 | 9/1992 | Daneshvar | 281/31 |
| 5,156,898 | 10/1992 | McDonald | 428/100 |
| 5,256,254 | 10/1993 | Pease | 162/199 |
| 5,362,103 | 11/1994 | Bromberg | 281/29 |
| 5,648,143 | 7/1997 | Mehta | 428/137 |

OTHER PUBLICATIONS

William Exline Brochure, Jan., 1995.

*Primary Examiner*—Nasser Ahmad

*Attorney, Agent, or Firm*—Rhodes, Coats & Bennett, L.L.P.

[57] ABSTRACT

A wallet size card book which has been adapted to hold a card having the dimensions of a conventional credit card, and is particularly designed to be carried in the credit card compartment of a wallet or similar size compartment holder. The use of an adhesive strip extending along the marginal edges between a first and second leaf in the card book makes it possible to create a properly formed pocket for holding and protecting the card. The preferred adhesives for the strip include latexes of polyvinyl ethylene, polyvinyl acetate, other acrylics, and copolymers thereof. The preferred adhesive is a polyvinyl acetate copolymer latex having a glass transition temperature (Tg) approximately room temperature or below.

25 Claims, 2 Drawing Sheets

ADHESIVE STRIP FOR USE IN A WALLET SIZE CARD BOOK

REFERENCE TO RELATED APPLICATIONS

This application is a continuation-in-part of U.S. application Ser. No. 08/418,567, filed Apr. 7, 1995 now U.S. Pat. No. 5,595,401.

BACKGROUND OF THE INVENTION (1) Field of the Invention

The present invention relates generally to an article designed to hold and protect identification, credit, debit, and other smart cards, and any information encoded on a magnetic stripe or microchip. More particularly, the present invention relates to a narrow adhesive strip, which allows a pocket to be formed for holding a card having dimensions of a conventional credit card in a wallet size card book or other applications.

(2) Description of the Prior Art

Various booklets or folders having card holder pockets and a place to record information or transactions are currently in use. For example, U.S. Pat. No. 5,143,405 (Daneshvar) discloses a booklet for collecting and presenting personal medical information. Although the booklets include pockets formed in the covers of the booklets, the disclosure provides that the pockets may be used to hold additional papers containing medical information. The suggested size of the booklet is approximately 4"×6⅛", and by size alone, would not conveniently fit into the user's wallet. Further, there is no indicated use of the pockets for holding identification and credit cards.

U.S. Pat. No. 4,621,729 (Jackson) discloses a patient medical information and education container which may be wallet size. Although a pocket is provided which serves to hold a plurality of cards or the like, the user must open a plurality of panels of the container to retrieve a card from the pocket.

U.S. Pat. No. 2,767,756 (Niles) discloses a foldable unit plastic card holder designed to hold a number of cards. However, the card holder does not include any pages on which to record transactions or maintain record-keeping.

U.S. Pat. No. 3,360,027 (Price) discloses a ticket and money holder provided with openings with arcuate lower edges through which tickets and the like may be inserted into and removed from the holder. The holder includes an outer sheet which is stitched to a filler.

Standard size card books are also available, for example, savings and passbooks. However, these card books are too cumbersome in size to fit within the compartments of a wallet. Moreover, attempts to produce wallet size card books have been unsuccessful because the available marginal width is not sufficient to obtain a strong glue bond with previously used adhesives. Thus, there remains a need for a new and improved wallet size card book which is sized to fit within a wallet but is strong enough to survive normal usage.

SUMMARY OF THE INVENTION

The present invention relates to a wallet size card book which is of a suitable size and configuration large enough to retain a conventional size credit card and yet small enough to fit within the card compartments of a wallet or similar type compartment holder. In this regard, there is provided a smaller size card book having dimensions of approximately 2½ inches by 3½ inches. The use of a resin emulsion adhesive, preferably a polyvinyl acetate copolymer emulsion, makes it possible to create a properly formed pocket for holding and protecting the card.

The wallet size card book as contemplated by the present invention includes: (a) a cover having a fold which divides the cover into a front cover panel and a rear cover panel; (b) a plurality of leaves attached at the fold, the leaves forming pages; (c) a L-shaped adhesive strip extended along two edges of the inner surface of the cover; and (d) a pocket formed by a first leaf sealed to the inner surface of the cover and cut shorter and narrower than the cover, a second leaf sealed along two edges to the L-shaped adhesive strip on the cover with a third edge secured to the fold by stitching, gluing or stapling, and a fourth edge remaining open for receiving a credit or information card. The smaller size coupled with the same standard size for credit cards requires a substantially narrower glue strip along two adjacent sides.

Accordingly to the present invention, the adhesive must possess the following properties for use in the wallet size card book: 1) sufficient bond strength; 2) fast cure to porous substrates under ambient conditions; and 3) sufficient bond flexibility. The adhesive strip that is used to seal leaves of wallet size card books comprises an adhesive selected from the group consisting of latexes of polyvinyl ethylene, polyvinyl acetate, acrylics and any copolymer thereof, natural rubber latex, natural rubber solvent-based, protein glue, carbohydrate polymer, aerobic adhesives, cyanoacrylates, silicones, and epoxy resins. The preferred adhesive is a polyvinyl acetate copolymer latex with a glass transition temperature (Tg) approximately near or below room temperature.

For purposes of discussion, the narrow adhesive strip is described in connection with a wallet size card book. It is contemplated that the adhesive strip may be used in other applications where the creation of a pocket is desired.

These and other aspects of the present invention will become apparent to those skilled in the art after a reading of the following description of the preferred embodiment when considered with the drawings.

DESCRIPTION OF THE PREFERRED EMBODIMENTS

Figure 1:
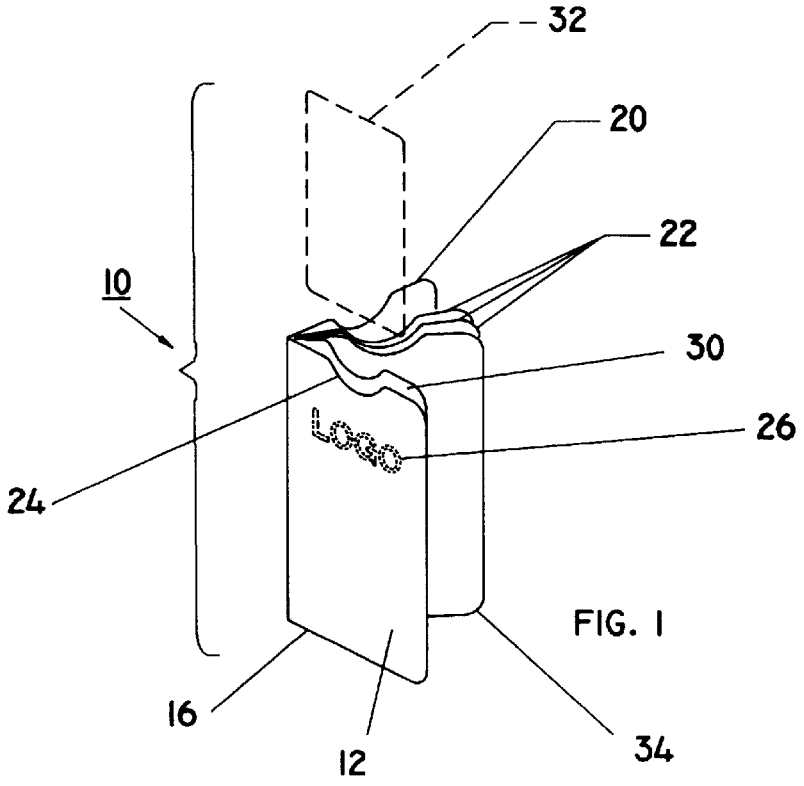
FIG. 1 is a perspective view of a wallet size card book constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 6:
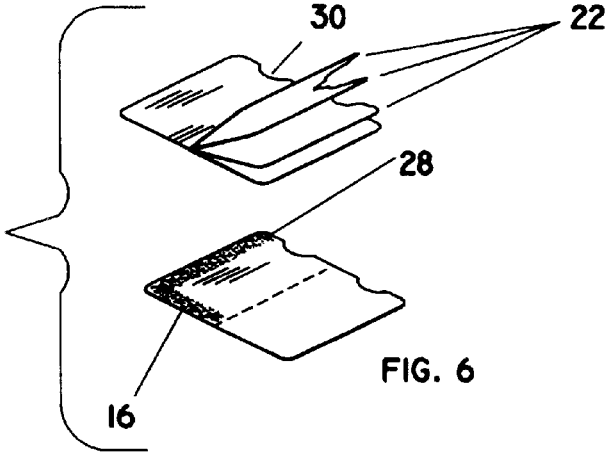
FIG. 6 is an exploded perspective view of the wallet size card book.

Referring now to the drawings in general and FIG. 1 in particular, it will be understood that the illustrations are for the purpose of describing a preferred embodiment of the invention and are not intended to limit the invention thereto. As best seen in FIG. 1, the wallet size card book, generally designated 10, comprises a cover 12 having a fold 14 which divides the cover into a front cover panel 16 and a rear cover panel 20, a plurality of leaves 22 attached at fold 14, with the leaves forming pages, and a L-shaped adhesive strip 28 (shown in FIG. 6) formed along two edges of the inner surface of at least one cover panel. The card book 10 further includes arcuate recesses 24 in the upper edges of the cover 12 and plurality of leaves 22. Cover 12 comprises a lexide material, and indicia 26, for example, a logo, may be placed on the front cover panel 16 of the book. The card book 10 also includes a pocket 30 for holding and protecting a wallet size credit card 32 or comparable size information card.

Pocket 30 of the card book 10 is formed by a first leaf being sealed completely to the inner surface of the cover 12 and cut shorter and narrower than the cover, a second leaf being sealed along two edges to the L-shaped glue strip 28 on the inner surface of cover 12 with a third edge attached at fold 14 by stitching, gluing or stapling and a fourth edge remaining open for receiving the card 32.

There are a large number of commercially available adhesives which may be used for card book 10. The required properties for use in the wallet size card book are: 1) sufficient bond strength, a minimum of 10#/linear inch; 2) fast cure to porous substrates under ambient conditions; and 3) sufficient bond flexibility so as not to tear under normal use of the product. Sufficient bond strength is defined as that which will endure beyond cohesive failure of the substrate. Fast cure is relative to the manufacturing procedure being used, but generally means that the development of green tack should require between about 5 to about 10 seconds. The bond must also be able to endure the routine flexing of the card book 10, and must not embrittle with age. Any adhesive meeting these requirements can be used for the L-shaped adhesive strip line in the manufacture of the card book 10. The following adhesives may be used in the card book 10; however, these examples are by no means exhaustive.

The preferred adhesives for the card book application are latexes of polyvinyl ethylene, polyvinyl acetate, other acrylics, or copolymers of these. They meet all the requirements as described above, are water based, and are easy to work with during the manufacturing process. The preferred adhesive is a polyvinyl acetate copolymer latex with a glass transition temperature (Tg) approximately near or below room temperature.

Protein glues, in both dry and liquid form, on porous substrates such as paper, develop good strength, cure quickly at room temperature, and exhibit flexibility. Protein glues include soybean adhesives, animal blood adhesives, casein, and blends. This group also includes glues made from animal bone and hide (including fish), and is commonly used in bookbinding.

A number of carbohydrate-based adhesives (also known as polysaccharides) are also feasible candidates for application to card book 10. This family includes the cellulosic adhesives, starch, and gums. Although several in this group have been completely replaced by synthetic polymers, they are still widely available. Starch and gums, such as guar gum or tamarind, are good candidates and have traditionally been used as laminating adhesives for paper substrates.

Cellulose nitrate and cellulose acetate are viable, but do not age well. They will embrittle with time, and also discolor if routinely exposed to sunlight. Cellulose acetate butyrate avoids these problems, but is solvent-based and more difficult to work with. The preferred examples from this family are methyl or ethyl cellulose, and hydroxyethyl cellulose.

Natural rubber may also be used to form the L-shaped adhesive strip 28. It can be obtained either in solution (usually in toluene, naphtha, or trichloroethylene), or as a water-based latex. Although it possesses sufficient properties, consistency and availability are potential problems.

There are several other classes of adhesives which have sufficient properties, but may not be optimum choices for application in the present invention due to cost, handling and/or storage problems. These include cyanoacrylate adhesives, silicone adhesives, epoxy resins, and others. Further, although they exhibit excellent properties and are relatively easy to use, the new aerobic adhesives fall within this category at the present time due to their high cost.

There are a number of adhesive types which are not commercially viable for application in the present invention due to their curing conditions and/or lack of flexibility. These would include such adhesive types as hot melt, phenolic, polysulfide, and anaerobic adhesives. While it is possible some of these adhesives could be made useable through such mechanisms as catalysts to reduce required cure temperature, the cost would most likely be prohibitive. Those systems which require a high temperature cure usually require temperatures in excess of 110 degrees Celsius (225 degrees Fahrenheit). Such temperatures would scorch the paper substrate of the card book.

In one embodiment of the present invention, the L-shaped adhesive strip 28 comprises a resin emulsion adhesive (Evans No. 04053, Evans Adhesive Corp., Columbus, Ohio). The composition of Evans No. 04053 comprises a vinyl acetate ethylene copolymer emulsion. The adhesive may include other additives, for example, a defoamer. The copolymer emulsion is water-based and contains approximately 45% water; and the vinyl acetate ethylene content in the copolymer is approximately >90.0 wt. %. It is contemplated that any comparable adhesive may be used to form the L-shaped adhesive strip. The width of the adhesive strip ranges between 1/16 inch to about 1/4 inch. The adhesive strip preferably extends approximately 1/16 inch from the bottom edge of the inner surface of cover 12 to about 3/16 inch from the side edge of the inner surface of cover 12.

Figure 2:
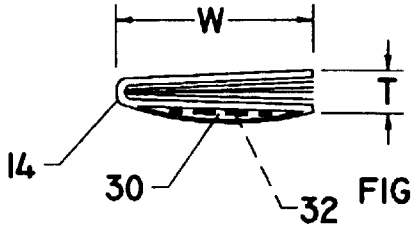
FIG. 2 is a top view of the wallet size card book.
Figure 3:
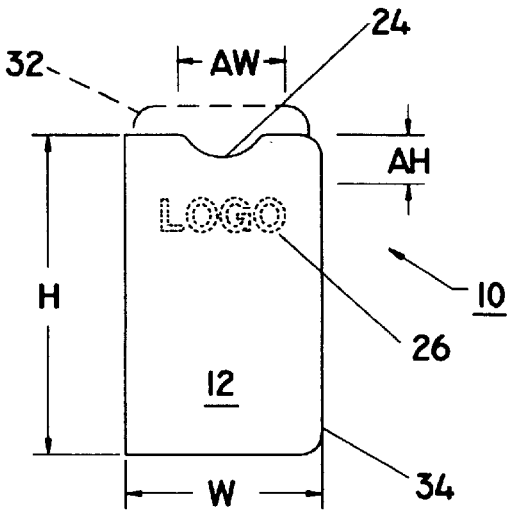
FIG. 3 is a front view of the front cover panel of the wallet size card book.
Figure 4:
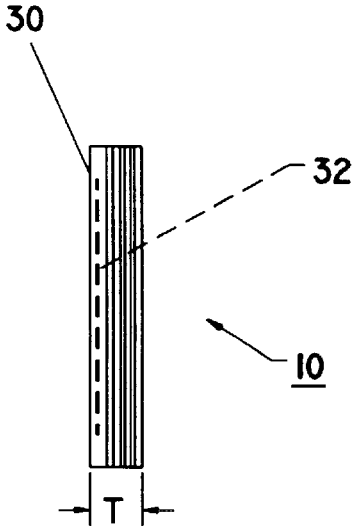
FIG. 4 is a side view of the wallet size card book.

As shown in FIG. 3, the book 10 has upper and lower rounded edges 34 opposite the fold 14. Rounded edges 34 are between about 1/8 inch to 3/8 inch in diameter, with a preferred diameter of 1/4 inch. The height H of book 10 ranges between approximately 3 5/16 inches to about 3 5/8 inches, with a preferred height of 3 1/2 inches. The width W of book 10 ranges between about 2 3/8 inches to about 2 5/8 inches, with a preferred width of 2 1/2 inches. As shown in FIGS. 2–4, the thickness T of book 10 ranges between about 1/16 inch to about 3/16 inch with a preferred thickness of 1/8 inch.

Again referring to FIG. 3, the arcuate recesses 24 have a width AW ranging between approximately 7/8 inch and 1 1/8 inches, with a preferred width of 1 inch. The depth AH of recess 24 ranges between 3/16 inch and 3/8 inch, with a preferred depth of 1/4 inch. The arcuate recesses facilitate the insertion and removal of card 32 from pocket 30.

Figure 5:
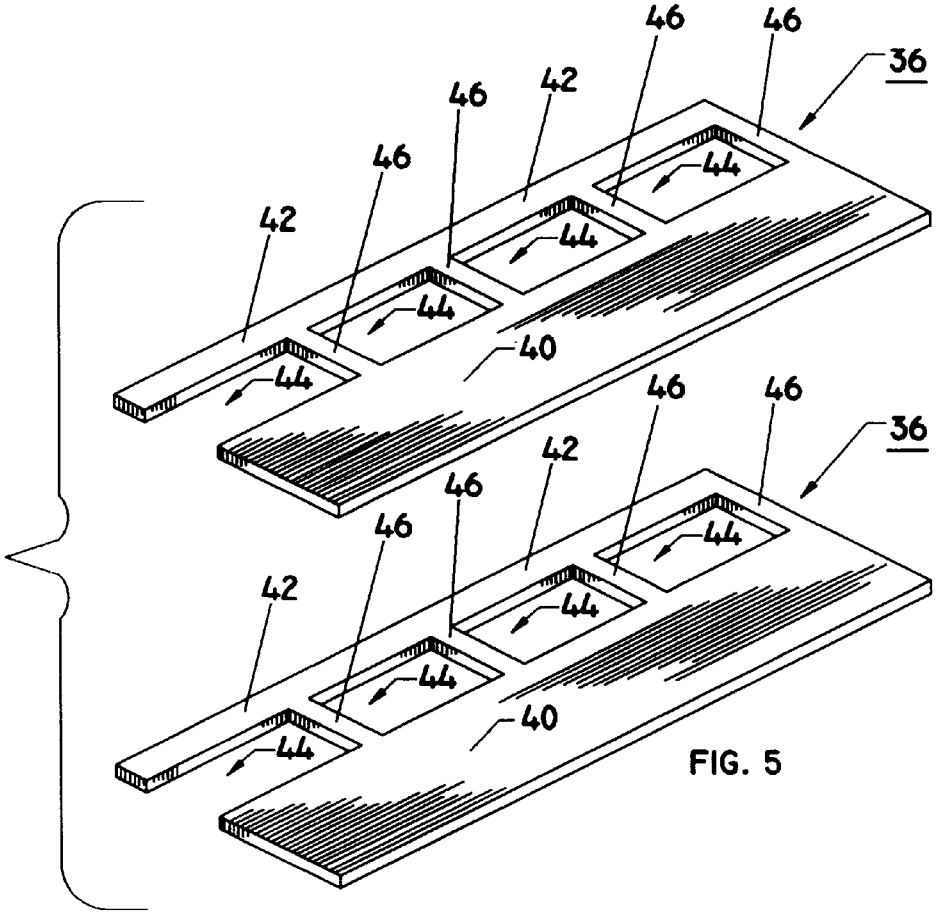
FIG. 5 is a perspective view of the upper and lower dies.

In producing card book 10 in accordance with the present invention, at least one card book 10 is placed in an open position where the plurality of leaves 22 are attached to fold 14 of the cover 12. The first or fly leaf is cut shorter and narrower than the cover 12 so that when the resin emulsion adhesive is applied to the entire inner surface of at least one cover 12, the first leaf completely adheres to the cover 12, and leaves and L-shaped adhesive strip 28 exposed along the marginal edges of the inner surface of cover 12. As a result, a second leaf adheres to the L-shaped adhesive strip 28 that remains exposed on the inner surface of cover 12, thereby forming a pocket with a third edge being attached at fold 14 and a fourth edge remaining open for receiving a card 32. In one embodiment of the invention, three books are placed end to end in an upstate position. During the process, anywhere from approximately 12–18 books may be placed between two dies 36 of the type shown in FIG. 5 immediately after the resin emulsion is applied. Die 36 includes a lower strip 40 and an upper narrow strip 42. A plurality of openings 44 exists between the upper and lower strips 40,42. Between adjacent openings 44 are adjoining strips 46.

The books and dies are placed in an air-powered vise, and thereafter squeezed together in order to set the adhesive. The vise is squeezed under approximately 2800 lbs/in$^2$ of pressure for a sufficient amount of time in which to properly seal the adhesive to the cover 12. The pressure may range between about 2000 and 4000 lbs/in$^2$. In a preferred embodiment, the vise may be squeezed between about 30 seconds and about one minute. The dies 36 function by applying pressure around the outer edges of the leaves, and help to seal the adhesive on the cover 12 of card book 10. As a result, a pocket 30 is created which is formed by sealing the first leaf and part of the second leaf to the inner surface of cover 12 using the L-shaped adhesive strip 28.

Certain modifications and improvements will occur to those skilled in the art upon a reading of the foregoing description. By way of example, it is contemplated that the card book of the present invention can be modified for use in a variety of industries including but not limited to financial institutions, telecommunications, healthcare, information security, travel and hospitality and prepaid vending. The card book may, thus, be customized to hold information about a particular organization and its services, programs, etc.

It should be understood that all such modifications and improvements have been deleted herein for the sake of conciseness and readability, but are properly within the scope of the following claims.

We claim:

1. A wallet size card book having a pocket formed between two adjacent paper pages or between a cover having a paper substrate and a paper page and being of a suitable size and configuration to retain a conventional size credit card and small enough to fit within the card compartments of said wallet, the improvement comprising an adhesive strip extending along at least one marginal edge having a width between about 1/16 inch to about 3/16 inch, and having sufficient bond strength ranging upwardly from a minimum of 10#/linear inch; fast curing times ranging between 5 and 10 seconds; and sufficient bond flexibility to avoid failure of maintaining said pocket in use.

2. The adhesive strip of claim 1, wherein the adhesive strip comprises an adhesive selected from the group consisting of latexes of polyvinyl ethylene, polyvinyl acetate, acrylics and any copolymer thereof, natural rubber latex, natural rubber solvent-based, protein glue, soybean, animal blood, casein and blends thereof, animal bone/hide, carbohydrate polymers, aerobic adhesives, cyanoacrylates, silicones, and epoxy resins.

3. The adhesive strip according to claim 1, wherein the adhesive strip extending along at least one marginal edge forms an L-shaped configuration.

4. The adhesive strip according to claim 2, wherein the adhesive is a polyvinyl acetate copolymer latex having a glass transition temperature (Tg) at approximately room temperature or below.

5. The adhesive strip according to claim 2, wherein the protein glue is selected from the group consisting of soybean, animal blood, casein and blends thereof, and animal bone/hide.

6. The adhesive strip according to claim 2, wherein the carbohydrate polymer is a cellulosic selected from the group consisting of cellulose nitrate, cellulose acetate, cellulose acetate butyrate, methyl/ethyl cellulose, and hydroxyethyl cellulose.

7. The adhesive strip according to claim 2, wherein the carbohydrate polymer is starch.

8. The adhesive strip according to claim 2, wherein the carbohydrate polymer is a gum.

9. The adhesive strip according to claim 2, wherein the adhesive is a vinyl acetate ethylene copolymer.

10. The adhesive strip according to claim 9, wherein the vinyl acetate ethylene copolymer is approximately >90 wt. %.

11. The adhesive strip according to claim 2, further including additives.

12. The adhesive strip according to claim 11, wherein the additive is a defoamer.

13. The adhesive strip according to claim 2, wherein the adhesive strip extends approximately 1/16 inch from the bottom marginal edge and approximately 3/16 inch from the side marginal edge of the first leaf.

14. An adhesive strip in combination with and extending along at least one marginal edge between two adjacent paper pages or between a cover having a paper substrate and a paper page of a card book and comprising an adhesive selected from the group consisting of latexes of polyvinyl ethylene, polyvinyl acetate, acrylics and any copolymer thereof, natural rubber latex, natural rubber solvent-based, protein glue, carbohydrate polymer, aerobic adhesives, cyanoacrylates, silicones, and epoxy resins, and wherein the adhesive strip is of a width sufficient to adhere the edge of one page to another, the width of said strip ranging between about 1/16 of an inch to about 3/16 inch.

15. The adhesive strip according to claim 14, wherein the adhesive strip extending along the marginal edges forms an L-shaped configuration.

16. The adhesive strip according to claim 14, wherein the adhesive is a polyvinyl acetate copolymer latex having a glass transition temperature (Tg) at approximately room temperature or below.

17. The adhesive strip according to claim 14, wherein the protein glue is selected from the group consisting of soybean, animal blood, casein and blends thereof, and animal bone/hide.

18. The adhesive strip according to claim 14, wherein the carbohydrate polymer is a cellulose selected from the group consisting of cellulose nitrate, cellulose acetate, cellulose acetate butyrate, methyl/ethyl cellulose, and hydroxyethyl cellulose.

19. The adhesive strip according to claim 14, wherein the carbohydrate polymer is starch.

20. The adhesive strip according to claim 14, wherein the carbohydrate polymer is a gum.

21. The adhesive strip according to claim 14, wherein the adhesive is a vinyl acetate ethylene copolymer.

22. The adhesive strip according to claim 21, wherein the vinyl acetate ethylene copolymer is approximately >90 wt. %.

23. The adhesive strip according to claim 14, further including additives.

24. The adhesive strip according to claim 23, wherein the additive is a defoamer.

25. The adhesive strip according to claim 14, wherein the adhesive strip extends approximately 1/16 inch from the bottom marginal edge and approximately 3/16 inch from the side marginal edge of the first leaf.

* * * * *